United States Patent [19]

Bullock et al.

[11] 4,068,839

[45] Jan. 17, 1978

[54] SHEET STACKING APPARATUS

[75] Inventors: Michael Kermit Bullock; Sherwood Anderson Clay; Gregory Bingham Overton, all of Boulder, Colo.

[73] Assignee: International Business Machines Corporation, Armonk, N.Y.

[21] Appl. No.: 774,579

[22] Filed: Mar. 4, 1977

[51] Int. Cl.[2] ..... B65H 29/44

[52] U.S. Cl. ..... 271/180; 271/217; 271/220

[58] Field of Search ..... 271/180, 181, 207, 213, 271/214, 215, 217, 220, 178, 177

[56] References Cited

U.S. PATENT DOCUMENTS

| | | | |
|---|---|---|---|
| 1,573,414 | 2/1926 | Mahoney | 271/220 X |
| 1,902,436 | 3/1933 | Joachim | 271/177 |
| 2,926,910 | 3/1960 | Martin | 271/178 |
| 3,095,192 | 6/1963 | Simjian | 271/3 |
| 3,304,083 | 2/1967 | Rasmussen | 271/71 |
| 3,537,704 | 11/1970 | Bond | 271/74 |
| 3,847,388 | 11/1974 | Lynch | 271/174 |
| 3,849,907 | 11/1974 | Lynch | 34/242 |
| 3,954,259 | 5/1976 | Gerbasi | 271/4 |
| 3,957,264 | 5/1976 | Bach | 271/173 |

OTHER PUBLICATIONS

Xerox Disclosure Journal, vol. 2, No. 1, Jan./Feb. 1977, p. 33, "Sorter Apparatus," John H. Looney.

*Primary Examiner*—Richard A. Schacher
*Attorney, Agent, or Firm*—Francis A. Sirr

[57] ABSTRACT

A dual exit tray xerographic machine, having a hot roll fuser, supplies its output copy sheets to a large-capacity exit pocket whereat the sheets are stacked in a vertically extending pile, on a servo-movable elevator platform. The platform height is servo controlled so as to maintain the stack's top sheet at a fixed position relative to a fixed-position, generally horizontally extending, sheet discharge path.

Sheet stacking is enhanced by a pair of movable bars. A hold-down bar, in its quiescent position, presses the stack's trailing edge portion down to insure reliable insertion of the next sheet. A pusher bar is maintained in an elevated quiescent position during such insertion.

After the sheet has been inserted, the pusher bar lowers onto the stack, at a position between the hold-down bar and the stack's leading edge. The pusher bar thus holds the just-inserted sheet down. The hold-down bar synchronously moves in a generally elliptical path, to first clear the trailing edge of the just-inserted sheet. The hold-down bar then moves in an upward path until it again overlies the stack's trailing edge. The hold-down bar now descends onto the stack, as the pusher bar returns to its quiescent position.

15 Claims, 5 Drawing Figures

SHEET STACKING APPARATUS

CROSS REFERENCE TO RELATED APPLICATION

"Paper Hold-Down Device for Collector," U.S. patent application Ser. No. 727,872, filed Sept. 29, 1976 in the name of Richard A. Lamos, and commonly assigned.

BACKGROUND AND SUMMARY OF THE INVENTION

Reliable stacking of paper sheets is a well known problem. Paper sheet stacks of large vertical height tend to curl such that insertion of the next sheet is obstructed. This phenomenon varies as a function of humidity, temperature, and the characteristics of the sheet processing machine. It is particularly troublesome in the art of xerographic machines having a hot roll fuser. This fuser not only heats and drys the sheet, but also tends to "iron" a curl into the sheet.

Various sheet stacking means have been provided in the prior art. For example, air jets and mechanical fingers have been utilized to push the sheets down onto the stack. In high speed card stacking devices, stacking rollers have been provided to engage the stack's trailing edge and to bend the stack's entire trailing edge away from the path of the next card's insertion.

In the art of xerography, collators adapted to stack sheets have been constructed and arranged such that each collator bin includes a flexible entrance flap to hold down the stack's trailing edge so as not to obstruct insertion of the next sheet. Copy exit trays of xerographic machines have been provided with paper feed rolls, one of which includes a long, resilient flap whose function it was to aid in sheet stacking. In addition, original documents fed to the platen of a xerographic copier have been returned to a stacking tray after copying, wherein the tray includes a 180° rotatable two-bar linkage. This linkage includes one bar to hold the stack down for insertion of the next sheet. After insertion the linkage is rotated 180° in preparation for the next sheet.

The present invention advances the art of sheet stacking by a unique relationship of structural elements, including a two-bar hold-down mechanism of unique movement relationship.

The present invention stacks sheets on a vertically adjustable platform. Thus, the troublesome variables, introduced as the relative positions of the sheet's entry path and stacking plane change, are eliminated.

As is well accepted in the art, a hinged wire form, supporting a decelerating roller, is engaged by the sheet's leading edge, as the sheet is stacked. However, since the stack height is controlled at a given position, the angle of attack between the sheet's leading edge and this wire-form is maintained constant, and another troublesome variable is eliminated.

The present invention's two above-mentioned bars comprise a pusher bar and hold-down bar. In the quiescent position of these bars, i.e. their positions as they await the insertion of the next sheet, the pusher bar is elevated above the stack. The movement of this bar is essentially oscillatory-linear, in a generally vertical direction. Thus, this bar can be stored in a minimum size cavity, in a continuous wall extending between the sheet's entry path and the above-mentioned wire form. In this manner, catching of the sheet's leading edge, as for example due to electrostatics, is minimized.

The hold-down bar, in its quiescent position, rests on top of and holds down the stack's trailing edge portion, so as to prevent obstruction of the next sheet to be inserted.

After this sheet has been inserted, its trailing edge resides between the two bars. The pusher bar now descends vertically onto this sheet, at a point between the hold-down bar and the sheet's leading edge, and pushes its generally trailing edge portion down onto the stack. The hold-down bar now begins a generally circular movement. The first portion of this movement is generally in the plane of the stack's top sheet, and toward its trailing edge. This movement continues until the hold-down bar has moved far enough to clear the trailing edge of the largest size sheet to be stacked. The hold-down bar now moves up, back over the stack, and down onto the stack, to its quiescent position. The pusher bar has by this time returned to its elevated quiescent position.

The above-described movement of the present invention's two-bar mechanism allows the sheet stacking apparatus to function in the small space required for optimum sheet stacking from a fixed sheet entry path to a stack of fixed height.

The foregoing and other features and advantages of the invention will be apparent from the following more particular description of a preferred embodiment of the invention, as illustrated in the accompanying drawing.

DESCRIPTION OF THE PREFERRED EMBODIMENT

While the present invention will be shown and described in the environment of xerographic apparatus having a hot roll fuser, in its broader aspects it has utility when used to stack flexible sheets received from a variety of output devices, and particularly those adapted to induce sheet curl. Special utility is recognized, however, in the xerographic hot roll fuser environment which markedly contributes to sheet curling.

Figure 1:
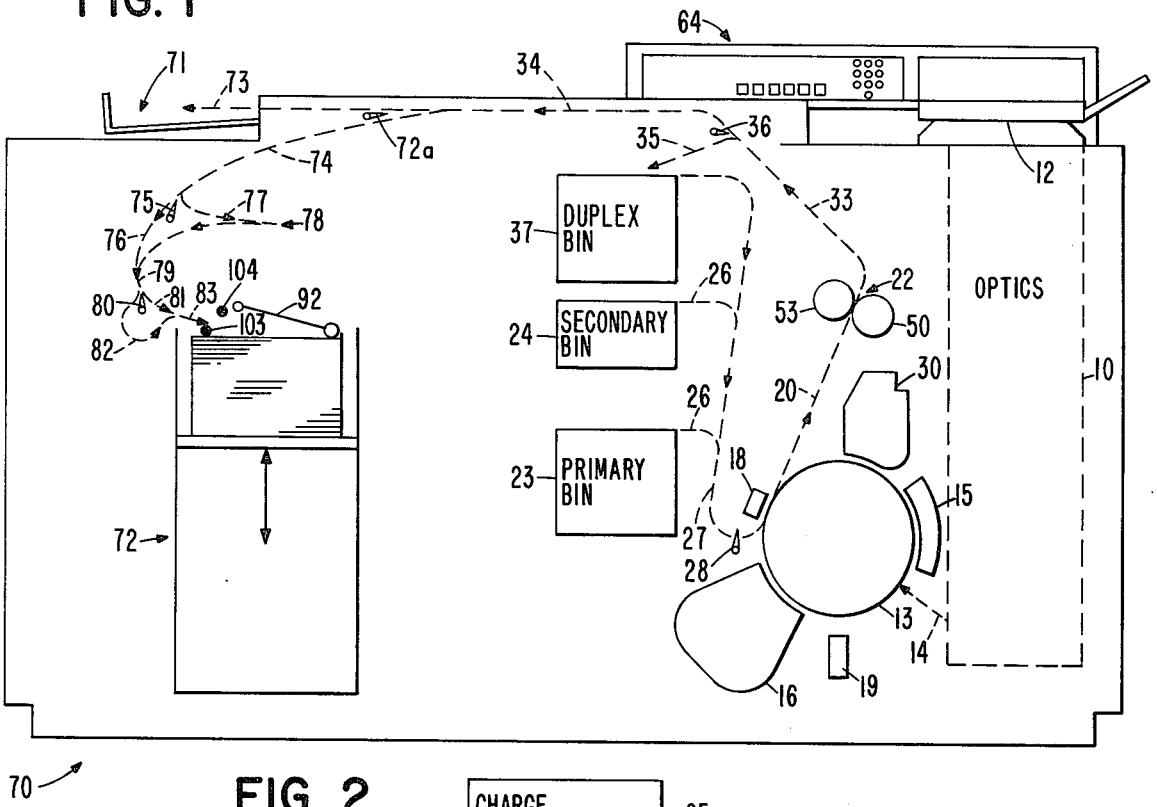
FIG. 1 is a schematic view of a dual exit tray xerographic copying apparatus incorporating the present invention.

FIG. 1 is a schematic view of copying apparatus incorporating the present invention. In this apparatus optics system 10 is constructed and arranged to place the latent image of an original document 12 onto photoconductor drum 13. As is well known, prior to imaging at 14 the drum is charged by corona 15. After imaging, the photoconductor's non-working area, i.e. the area which will not cooperate with a sheet of paper at the transfer station, is erased at erase station 19.

The apparatus of FIG. 1 includes two copy sheet supply bins 23 and 24. These supply bins include a bidirectionally movable elevator which supports the bottom sheet of the stack. While this structure is well known to those of skill in the art, an exemplary structure is described in the IBM TECHNICAL DISCLOSURE BULLETIN of August 1974, at pages 670 and 671. A sheet feeder within each bin is operable to feed the top sheet of the stack to sheet discharge path 26. This sheet then travels down sheet path 27 to be momentarily stopped at leading-edge alignment gate 28. When the leading edge of the drum's toned image arrives at the vicinity of the gate, the gate is opened to allow the sheet to progress under transfer corona 18 in exact registry with the drum's image. An exemplary means of picking the top sheet from the bin is described in the IBM TECHNICAL DISCLOSURE BULLETIN of February 1974, at pages 2966 and 2967.

The construction of the hot roll fuser is well known in the art. Generally, hot roll 50 is heated to an accurately controlled temperature by an internal heater and an associated temperature control system, not shown. The hot roll preferably includes a deformable external surface formed as a thin elastomeric surface. This surface is designed to engage the toned side of the copy sheet, fuse the toner thereon, and readily release the sheet with a minimum adherance of residual toner to the hot roll. Such a hot roll is described, for example, in the IBM TECHNICAL DISCLOSURE BULLETIN of August 1973, at page 896.

The nip formed by rolls 50 and 53 is preferably opened and closed in synchronism with the arrival and departure of the leading and trailing edges, respectively, of a copy sheet. This synchronism is achieved by a drum position sensing means, not shown, which responds to the position of drum 13 and effects opening and closing of the nip by means of a control system, not shown. An exemplary mechanism for effecting the opening and closing of this nip is shown in the IBM TECHNICAL DISCLOSURE BULLETIN of May 1973, at page 3644.

The exemplary xerographic apparatus of FIG. 1 is capable of duplex copying, i.e. copying on both sides of a sheet of paper. The IBM Series III copier/duplicator is an example of one such apparatus. The sheet path downstream of path 33 diverts to one of two paths 34 or 35. When operating on side one of the duplex mode, deflector 36 is controlled to cause the paper to follow path 35, into duplex bin 37, blank side facing up. After all side-one copies are made, the sheets in bin 37 are fed one at a time to sheet path 27 for side-two copying. Thereafter, the sheets follow sheet path 20, 33, 34.

Figure 2:
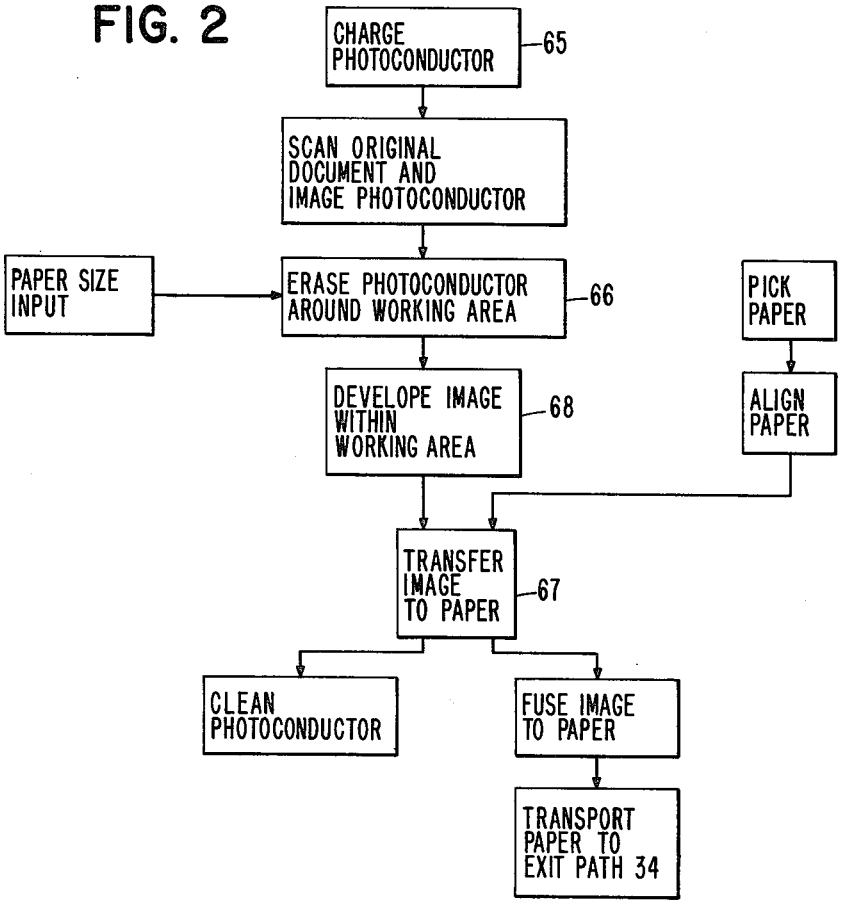
FIG. 2 is a flow-type representation of the xerographic process steps achieved by the copier's logic/-control panel of FIG. 1.

The copying apparatus of FIG. 1 is controlled by logic/control panel 64 in a manner well known to those of skill in the art. This control is depicted in FIG. 2, and is typical of the execution of a single simplex copy request. The first event to occur is that of charging the photoconductor, as at 65. Thereafter, the original document is scanned and a latent electrostatic image thereof is formed on the photoconductor. By definition, that area of the photoconductor which will correspond to a sheet of paper at the transfer station is the working area. Due to the basic electrostatic mechanism of the developing process, it is desirable that the photoconductor be discharged, i.e. erased, in the area around or bordering this working area. Thus, the next process step is that of erasing, as at 66.

At or about this same time, a sheet of paper is picked from one of the bins. While the photoconductor's image is developed, as at 68, the sheet of paper is aligned at gate 28 in preparation for transfer.

Thereafter, the photoconductor's toned image and the sheet of paper move under transfer corona 18 to transfer the toner to the paper, as at 67.

As the last steps in the process, the photoconductor is cleaned, as the toner is fused onto the paper sheet. The finished copy is now transported to exit path 34.

If desired, the erase function can be controlled in accordance with the paper size in use, i.e. the paper size in the bin currently in use.

Returning again to FIG. 1, the apparatus disclosed therein includes a dual exit tray 70 located downstream of sheet path 34. This dual exit pocket includes a small sheet-capacity tray 71 and a large sheet-capacity tray 72, for example of 400 and 2,000 sheet capacity, respectively. As a sheet progresses along sheet path 34, a deflector **72*a* is controlled to cause the sheet to divert to one of the sheet paths 73 or 74. The position of deflector 72*a* is under the control of operator selection, depending upon the desired use of tray 71 or 72. If tray 72 is selected, then another diverter 75 operates to cause the sheets to selectively move through sheet path 76 or 77. Sheet path 76 is the simplex sheet path whereas sheet path 77 is the duplex sheet path. All duplex printed sheets must pass through sheet turnover mechanism 78 in order to have correct page orientation in tray 72. Turnover mechanism 78** may, for example, be that described in U.S. Pat. No. 2,901,246.

As the sheet progresses toward the tray 72, along sheet path 79, a further deflector 80 is encountered. In one position, this deflector allows the sheet to follow path 81, whereas in the alternate position, the sheet follows path 82, this being a sheet offsetting mechanism producing lateral displacement of each sheet following path 82, for example, for the purpose of job separation within tray 72. An exemplary sheet offsetting mechanism is shown in the copending application of Michael K. Bullock, entitled "Job Separation by a Skewed Trough in the Paper Path", Ser. No. 727,873, filed Sept. 29, 1976, and commonly assigned.

The sheet entrance path to tray 72 comprises path 83.

Figure 3:
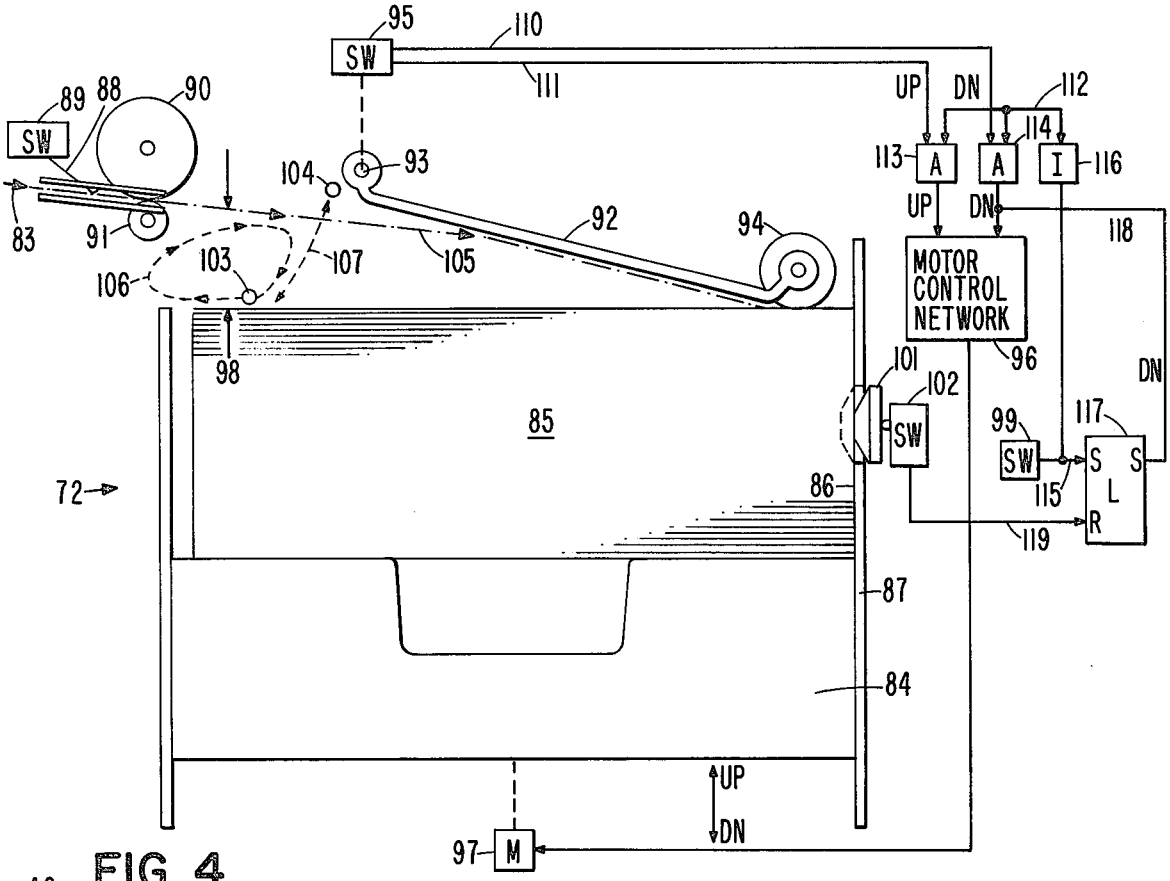
FIG. 3 is a schematic view of FIG. 1's print tray, showing the present two-bar hold-down mechanism.

FIG. 3 discloses the detail of FIG. 1's tray 72. As shown, a number of sheets have been placed on movable platform 84 to form a stack 85 whose trailing edge 86 registers against fixed-position wall 87. These sheets enter the apparatus while traveling along fixed-position sheet path 83.

The leading edge of a sheet first encounters a movable wire finger 88 which in turn activates switch 89, indicating that a sheet is about to be placed on top of stack 85. Immediately thereafter, the sheet enters the drive nip formed by rollers 90 and 91. These rollers drive the sheet toward fixed-position reference wall 87. The sheet's leading edge is guided down onto the stack by a swinging wire form 92 which is pivoted at 93 and has one end gravity-biased down onto the top of the stack. The end of this wire form includes an anti-rebound device in the form of a pair of spaced rollers 94. These rollers engage spaced portions of the sheet and each roller may include a clutch, not shown, operable to allow only counterclockwise rotation of the roller. Thus, should a skewed sheet enter the tray, the leading portion of its leading edge will be held against wall 87 as the total leading edge engages the wall, eliminating the skew.

As the stack height increases, guide 92 pivots counterclockwise about its pivot 93. Sensing switch means 95 is controlled by this pivoting movement. This switch means, in turn, controls motor control network 96 and bidirectional elevator motor 97 to cause platform 84 to lower, thus maintaining the top sheet of the stack generally at the height shown. Thus, distance 98 is constant. This distance is selected to insure that guide 92 forms a small angle to the horizontal, thus inhibiting "roll-over" of the sheet's leading edge as it enters the tray.

When it is desired to remove the sheet stack, an operator opens an access door, not shown. This opening movement controls switch 99 which operates to lower platform 84 a given amount. The amount of lowering is sensed by a button 101 which is spring biased against the stack's leading edge. When the stack has been lowered the given amount, about 2 inches, this button moves to the left, to its dotted line position, and switch 102 is actuated. This switch operates to stop further lowering of platform 84, as by resetting an electronic latch.

A pair of straight movable bars 103 and 104 are operated under the control of switch 89 to insure proper stacking of a sheet's trailing edge down onto stack 85. These bars extend generally normal to the direction of sheet travel 83 and span a distance greater than the width of the sheet, the sheet's width being measured normal to the direction of sheet travel.

As a sheet enters tray 72, it generally follows path 105 and comes to rest with its trailing portion on top of bar 103 and under bar 104. Bars 103 and 104 are shown in their quiescent positions. A short time thereafter, as controlled for example by the output of a monostable timer which is started by switch 89, or by switch 89 sensing the sheet's trailing edge, bar 103 begins to move generally clockwise along path 106, and bar 104 begins to move down, following generally vertical path 107. As a result, bar 103 first operates to push down the trailing edge of stack 85. After bar 103 has moved beyond this trailing edge, bar 104 has moved down sufficiently far to push the new sheet's trailing edge down onto the stack. Thereafter, bar 103 moves the stack, and back onto its trailing edge quiescent position, as bar 104 returns upward to the quiescent position shown. The apparatus is now in a quiescent position, operable to receive the next sheet. Bar 103 now operates to hold the stack's leading edge out of interfering engagement with the next sheet, as the next sheet enters the tray, following path 83.

With reference to FIG. 1, the orientation of the sheets within bins 23 and 24 is such that they move in the direction of their narrow dimension. Thus, for example, 14 inch long legal size paper moves in the direction of its 8½ inch width. When paper comes to rest in either of the trays 71 or 72, its variable length dimension, for example the difference in length between legal and letter size paper, extends in a direction normal to sheet travel 73 and 83.

As is readily apparent from the above description, the speed relationship between the feeding of sheets into path 83 and the cycling of bars 103 and 104 must be such that bars 103 and 104 complete a cycle, and return to their quiescent position, prior to the arrival of the next sheet following path 83.

Figure 4:
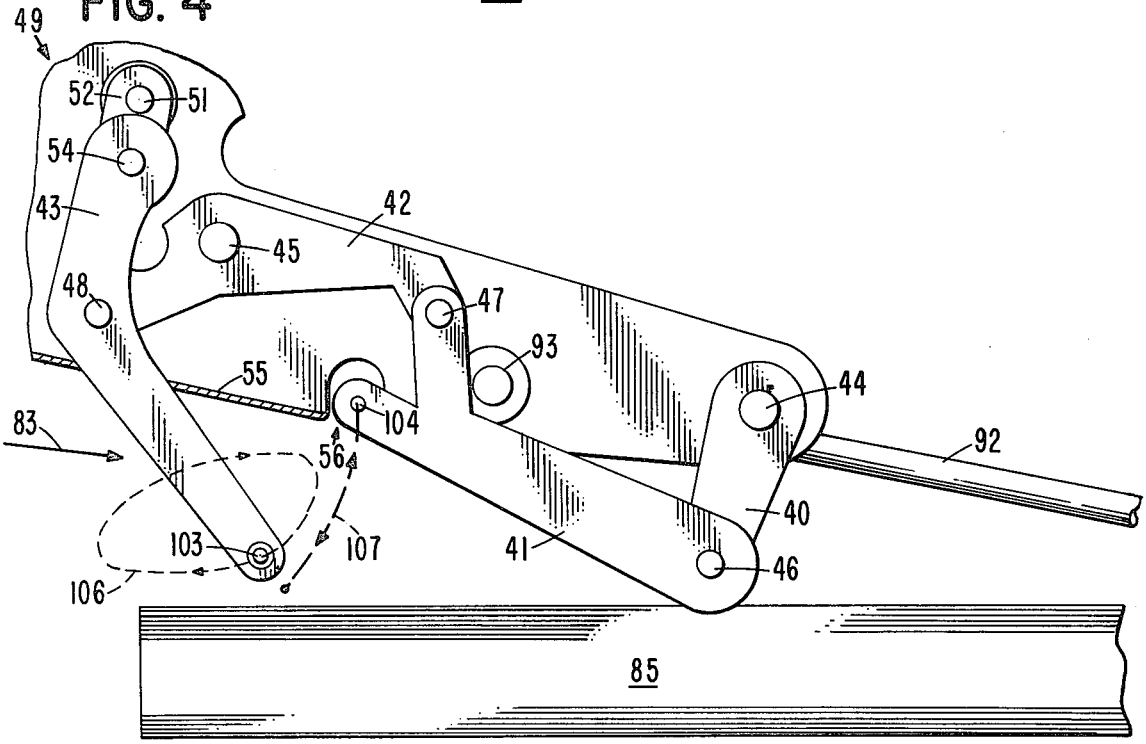
FIG. 4 is a side view of one of the two four-link mechanisms which support the two ends of the hold-down and pusher bars, and operate as motive means to achieve the required bar movement.

FIG. 4 is a side view, taken from the same side shown in FIG. 3, of one of the two four-link mechanisms which support the two opposite ends of the hold-down and pusher bars shown in FIG. 3, this mechanism operating as motive means to achieve the required bar movement, above described. Reference numerals 40, 41, 42 and 43 identify the first, second, third and fourth links, respectively, of this four-bar linkage. Links 40 and 42 are mounted on fixed position pivots 44 and 45, respectively. Link 40 is pivoted on the upper end thereof, and projects in a generally downward direction. Link 42 is pivoted at a point intermediate its ends, and projects substantially in a horizontal direction. Link 41 has its right-hand end pivotally secured to the lower end of link 40 by way of pivot 46. The upturned left-hand end of link 41 is pivotally secured to the end of link 42, which end is intermediate fixed pivots 44 and 45, as by way of pivot 47. Link 41 carries pusher bar 104 at a point intermediate its two ends. Link 43 extends in a substantially downward direction. Its lower end carries hold-down bar 103. An intermediate point on link 43 is pivotally secured to the left-hand end of link 42, as by way of pivot 48.

Input drive force to this four-bar linkage is provided by input drive means 49 comprising fixed position shaft 51 end extending drive link 52. The upper end of link 43 is pivotally secured to drive link 52 by way of pivot 54. One cycle of movement of input drive means 49 comprises 360° clockwise rotation from the quiescent position shown in FIG. 4 and returning to this position.

As shown in FIG. 4, the upper surface of sheet path 83, within tray 72, is defined by a stationary, substantially horizontal wall 55 which extends the width of the tray, and a width longer than the width of stack 85, the width being measured normal to the direction of sheet movement. This wall includes a long recess 56 which is substantially half-circle in cross section, and which operates to house bar 104 in its quiescent position. Since the movement of bar 104 is essentially linear, recess 56 can be of small size, only somewhat larger than the cross section of bar 104. Thus, any tendency of an inserted sheet's leading edge catching in the recess, as by electrostatic attraction, is minimized. Also, as shown, wire form 92 comprises an extension of the surface formed by wall 55.

As is usual practice, the electrostatic charge of a sheet is minimized by a sheet discharge means, not shown, associated with the sheet discharge path of the xerographic apparatus of FIG. 1.

Figure 5:
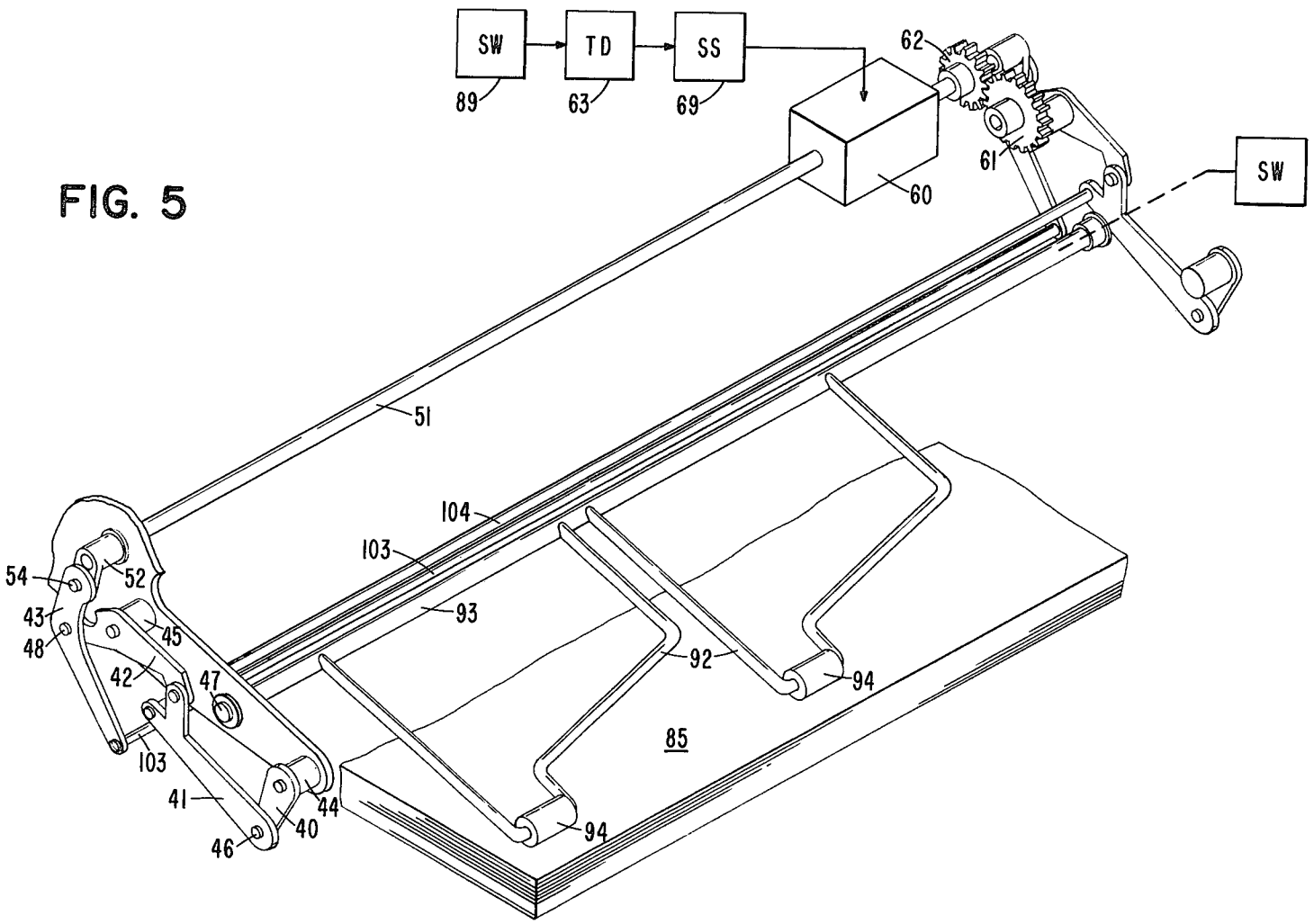
FIG. 5 is a perspective view of the device schematically illustrated in FIG. 3.

The perspective view of FIG. 5 discloses both of the four-bar linkages, above described, as well as electrically energizable single revolution clutch 60 whose momentary energization is effective to produce one 360° clockwise revolution of shaft 51. This clutch serves to couple the continuous rotational input from gears 61 and 62 to shaft 51. An exemplary means of energizing this clutch is by way of switch 89 (see FIG. 3) whose output energizes a time delay network 63 and a monostable single shot 69 to effect a short period of energization of clutch 60, such that the clutch produces but one 360° clockwise revolution of shaft 51 for each sheet insertion, rotation beginning substantially as the sheet comes to rest within tray 73, or shortly thereafter.

The exact manner in which motor 97 (FIG. 3) is controlled forms no part of the present invention, and the servo means for controlling stack height can be implemented in many ways, known to those of skill in the art. An exemplary arrangement is shown wherein switch means 95 includes two output conductors 110 and 111. Conductor 110 is active when the stack's height is too high, and conductor 111 is active when the stack's height is too low. The differential in stack height, during which both conductors are inactive, is about ¼ inch.

Assuming conductor 112 to be active, AND's 113 and 114 are enabled to pass the active one of the signals on conductors 111 and 110, respectively, to motor control network 96. This network, which can take many forms well known to those of skill in the art, controls motor 97 in a manner to produce the required vertical movement of stack 85.

So long as the access door (not shown) to stack 85 is closed, switch 99 is inactive, and conductor 115 is inactive. Inverter 116 translates an inactive signal on conductor 115 to an active signal on conductor 112.

When this door is opened, so as to facilitate manual unloading of the stack, conductor 115 becomes active and AND's 113 and 114 are inhibited. The transition from inactive to active on conductor 115 operates to set latch 117, causing conductor 118 to become active. Network 96 responds by lowering stack 85 until switch 102 issues an active signal on conductor 119. This signal resets latch 117. Subsequently, when the door is closed, conductor 115 becomes inactive. As a result, AND 113, switch 95 and conductor 111 become operative to return the stack to its proper upper position.

While the invention has been particularly shown and described with reference to a preferred embodiment thereof, it will be understood by those skilled in the art that various changes in form and details may be made therein without departing from the spirit and scope of the invention.

What is claimed is:

1. Sheet hold-down apparatus for use in stacking flexible sheets in a substantially fixed-position horizontal plane from a substantially fixed-position sheet entrance path, the apparatus comprising:

a hold-down bar and a pusher bar having quiescent positions wherein said hold-down bar resides substantially in said horizontal plane, and operates to hold down the trailing edge portion of sheets within a stack, and wherein said pusher bar is positioned a distance above said horizontal plane, the space between said bars defining an unobstructed entrance for the insertion of a sheet;

sensing means responsive to the insertion of a sheet; and motive means controlled by said sensing means and operative to produce synchronized substantially vertical movement of said pusher bar down onto said inserted sheet and substantially into said horizontal plane, and back to its quiescent position, as said hold-down bar moves in a substantially circular path, first toward and beyond the trailing edge of said inserted sheet, then above said inserted sheet as said sheet is held down by said pusher bar, and then back to its quiescent position.

2. The sheet hold-down apparatus defined in claim 1 including a wall extending in the general direction of sheet movement, and spaced above said sheet entrance path, said wall including a recess which accepts said pusher rod when it is in its quiescent position, to thus minimize obstruction of the leading edge of a sheet to be inserted.

3. The sheet hold-down apparatus defined in claim 2 including a gravity-biased member having one end hinged so as to be an extension of said wall, and having the other end resting upon the leading edge of the sheets within a stack.

4. The sheet hold-down apparatus defined in claim 3 including a substantially vertical wall defining the leading edge of the sheets within a stack, and wherein said other end of said gravity-biased member includes means operable to absorb the kinetic energy of an inserted sheet, so as to cause the sheet's trailing edge to come to rest in a substantially vertical plane within the substantially circular movement of said hold-down bar.

5. The sheet hold-down apparatus defined in claim 4 including second sensing means associated with said gravity-biased member so as to sense the vertical position of the top sheet in a stack, a vertically movable platform upon which the bottom sheet in a stack rests, and motive servo means controlled by said second sensing means and operable to move said platform so as to maintain the top sheet of a stack substantially in said fixed-position horizontal plane.

6. The sheet hold-down apparatus defined in claim 5 including manual means operable to control said motive servo means so as to lower said platform to facilitate unloading of the stack.

7. The sheet hold-down apparatus defined in claim 6 wherein said sheet entrance path is associated with a sheet processing apparatus adapted to induce curl of the sheets.

8. The sheet hold-down apparatus defined in claim 1 wherein said motive means includes two four-bar linkages mounted beyond the side edges of the stack, and operable to effect movement of said hold-down and pusher bars, each of said linkages comprising:

a first and a third link mounted on fixed pivots, said first link being pivoted on one end thereof and projecting in a substantially downward direction, and said third link being pivoted at an intermediate point and projecting in a substantially horizontal direction;

a second link having one end pivotally secured to the other end of said first link, and the other end pivotally secured to an end of said third link which is intermediate said fixed pivots, said second link carrying said pusher bar at an intermediate point;

a fourth link extending in a substantially downward direction and having its lower end carrying said hold-down bar, an intermediate point pivotally secured to said third link at its other end; and input drive means connected to the upper end of said fourth link to effect 360° circular movement thereof, as said hold-down and pusher bars complete one cycle of movement from and returning to said quiescent positions.

9. In combination:

a xerographic apparatus for producing graphic matter on individual flexible sheets by means including a hot roll fuser;

means defining a substantially fixed-position sheet discharge path for said sheets;

means defining a substantially fixed-position horizontal plane, vertically below said sheet disclosure path, at which said sheets are stacked;

a hold-down bar and a pusher bar, extending in a direction substantially normal to said sheet discharge path, and having quiescent positions wherein said hold-down bar resides substantially in said horizontal plane and operates to hold down the trailing edges of sheets within a stack, and wherein said pusher bar is positioned a short distance above said horizontal plane, the space between said bars defining an unobstructed entrance for the insertion of a sheet;

sensing means responsive to the insertion of a sheet; and motive means controlled by said sensing means and operative to produce one cycle of movement of said hold-down and pusher bars for each inserted sheet, said movement being synchronized to produce substantially vertical movement of said pusher bar down onto said inserted sheet and substantially into said horizontal plane, and back to its quiescent position, as said hold-down bar moves in a substantially circular path, first toward and beyond the trailing edge of said inserted sheet, then above said inserted sheet as said sheet is held down by said pusher bar, and then back to its quiescent position.

10. The combination defined in claim 9 wherein the sheet discharge speed of said xerographic apparatus and the speed of operation of said motive means are such that said motive means completes said one cycle of movement prior to the arrival of the next sheet to be stacked.

11. The combination defined in claim 10 including a wall extending in the general direction of sheet movement, and spaced a short distance above said sheet entrance path, said wall including a recess which accepts said pusher bar when it is in its quiescent position, to thus minimize obstruction of the leading edge of a sheet to be inserted.

12. The combination defined in claim 11 including a gravity-biased member having one end hinged so as to be an extension of said wall, and having the other end resting upon the leading edge of the sheets within a stack.

13. The combination defined in claim 12 including a substantially vertical wall defining the leading edge of the sheets within a stack, and wherein said other end of said gravity-biased member includes roller means operable to absorb the kinetic energy of an inserted sheet, so as to cause the sheet's trailing edge to come to rest in a substantially vertical plane within the substantially circular movement of said hold-down bar.

14. The combination defined in claim 13 including second sensing means associated with said gravity-biased member so as to sense the vertical position of the top sheet in a stack, a vertically movable platform upon which the bottom sheet in a stack rests, and motive servo means controlled by said second sensing means and operable to move said platform so as to maintain the top sheet of a stack substantially in said fixed-position horizontal plane.

15. The sheet combination defined in claim 14 including manual means operable to control said motive servo means so as to lower said platform to facilitate unloading of the stack.

* * * * *